US006497053B2

(12) United States Patent
Rydzewski et al.

(10) Patent No.: US 6,497,053 B2
(45) Date of Patent: Dec. 24, 2002

(54) AIR DIFFUSER USED ON LOCOMOTIVE WITH AIR DRYERS

(75) Inventors: Richard M. Rydzewski, Erie, PA (US); David Petersen, Erie, PA (US); Michael Fitzgerald, Erie, PA (US)

(73) Assignee: General Electric Company, Schenectady, NY (US)

( * ) Notice: Subject to any disclaimer, the term of this patent is extended or adjusted under 35 U.S.C. 154(b) by 94 days.

(21) Appl. No.: 09/681,563

(22) Filed: Apr. 30, 2001

(65) Prior Publication Data

US 2002/0157274 A1 Oct. 31, 2002

(51) Int. Cl.[7] ..... F26B 21/06
(52) U.S. Cl. ..... 34/72; 34/79; 34/83; 34/84
(58) Field of Search ..... 34/72, 79, 80, 34/83, 84; 291/3, 13

(56) References Cited

U.S. PATENT DOCUMENTS

| | | | | | |
|---|---|---|---|---|---|
| 3,271,060 | A | * | 9/1966 | Kilgore et al. | 291/3 |
| 3,345,097 | A | * | 10/1967 | Smith | 291/11.1 |
| 5,136,793 | A | * | 8/1992 | Kubotani | 110/204 |
| 5,522,150 | A | * | 6/1996 | Schultz | 34/80 |
| 6,128,825 | A | * | 10/2000 | Cunkelman | 34/79 |

* cited by examiner

*Primary Examiner*—Jiping Lu
(74) *Attorney, Agent, or Firm*—Polster, Lieder, Woodruff& Lucchesi L.C.

(57) ABSTRACT

A locomotive air dyer air discharge conduit is configured to disperse a portion of the discharge air radially through one or more air dispersion openings in the side of the discharge conduit, thereby reducing the output velocity of the discharge air.

20 Claims, 2 Drawing Sheets

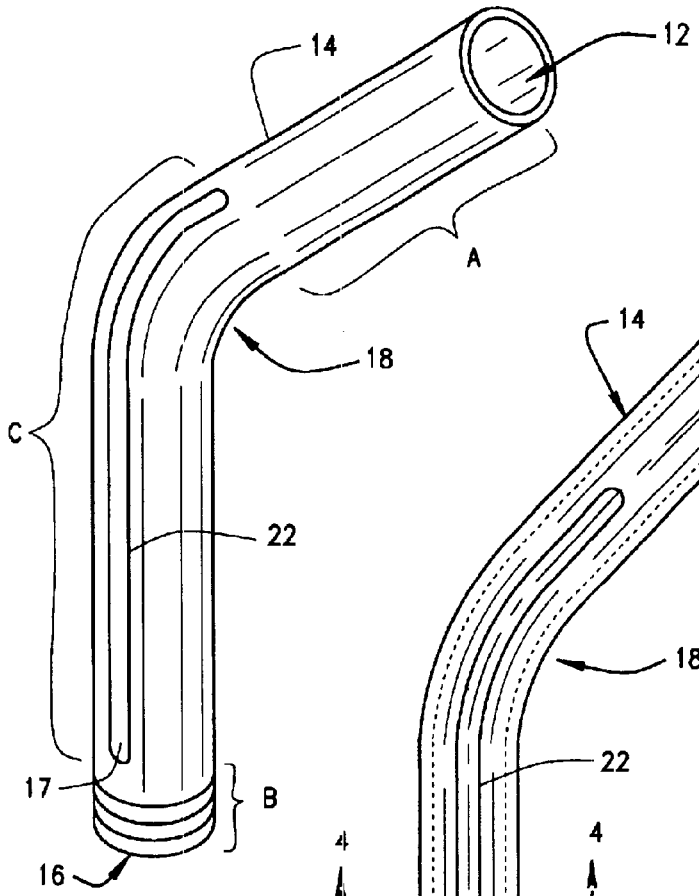
FIG. 2
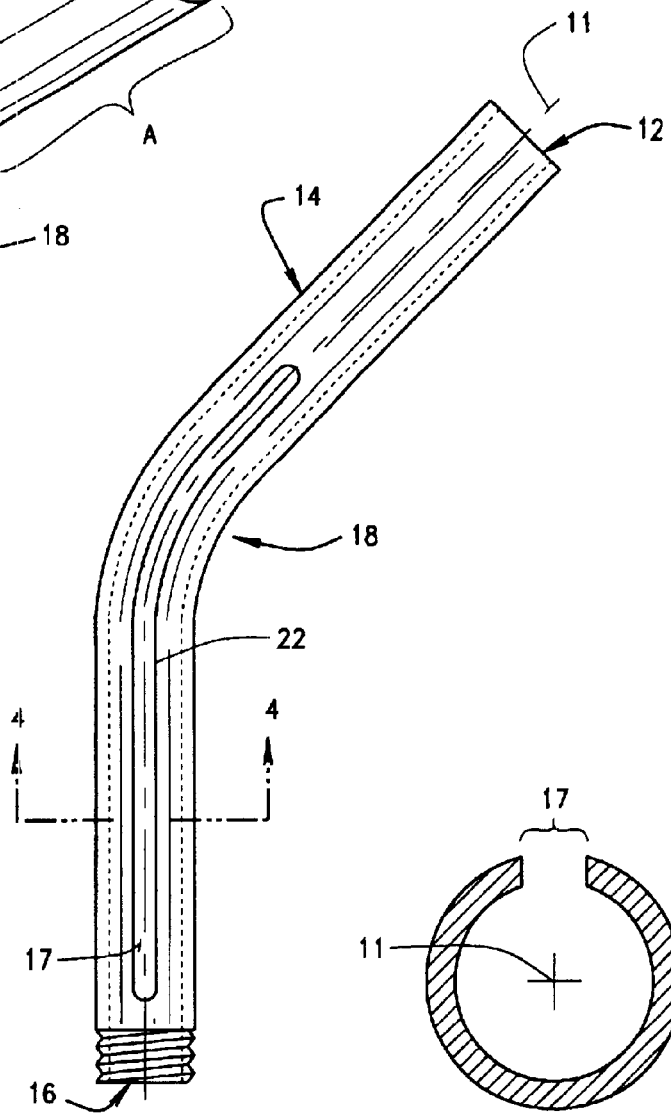
FIG. 3
FIG. 4

AIR DIFFUSER USED ON LOCOMOTIVE WITH AIR DRYERS

BACKGROUND OF INVENTION

The present invention is related to air discharge pipes through which high-pressure air is discharged from locomotive engine air dryers, and more specifically, to an improved air discharge pipe configured to diffuse discharge air.

Conventional railway locomotive engines include one or more air dryers for reducing moisture content in the pressurized air lines of the locomotive engine. Moisture collected in the air dryers is discharged as wet air from the air dryer at high pressure on regular intervals, typically on the order of once per minute. Discharged air is routed through an open end of a discharge pipe located on the side of the locomotive and directed both downward towards the railway track and inward to maximize personnel safety.

When a railway locomotive is stationary or idle, as is frequently the case during railcar loading and unloading or coupling and uncoupling, the discharge of high-pressure wet-air from the prior art air dryer discharge pipe can result in the displacement of adjacent ballast on the sides of the railway lines. Conventionally, the discharged air is initially pressurized to around 140 pounds per square inch (PSI). Repeated discharges at the same location can result in the formation of holes in the railway line ballast, leading to rail line deterioration and requiring repair.

Alternative air dryer discharge pipe designs incorporate a air-diffusing end cap fitted over the air discharge outlet end of the pipe. While this design has been found to be an improvement over conventional open-ended air discharge pipes, it does not significantly reduce the problem of rail line ballast displacement during high-pressure wet-air discharges from the locomotive engine air dryer.

SUMMARY OF INVENTION

Briefly stated, the apparatus of the present invention provides a locomotive air dyer air discharge pipe configured to disperse a portion of the discharge air radially through an air dispersion opening in the side of the discharge pipe, thereby reducing the output velocity of the discharge air and redirecting the air away from the ballast.

The foregoing and other objects, features, and advantages of the invention as well as presently preferred embodiments thereof will become more apparent from the reading of the following description in connection with the accompanying drawings.

BRIEF DESCRIPTIONS OF DRAWINGS

In the accompanying drawings which form part of the specification:

FIG. 2 is a perspective view of a first embodiment of an air dryer air discharge pipe of FIG. 1, incorporating a longitudinal air discharge opening;

FIG. 3 is a plan view of the air dryer air discharge pipe of FIG. 2; and FIG. 4 is a cross-sectional view of the air dryer air discharge pipe of FIG. 2, taken at section A—A.

Corresponding reference numerals indicate corresponding parts throughout the several figures of the drawings.

DETAILED DESCRIPTION

Figure 1:
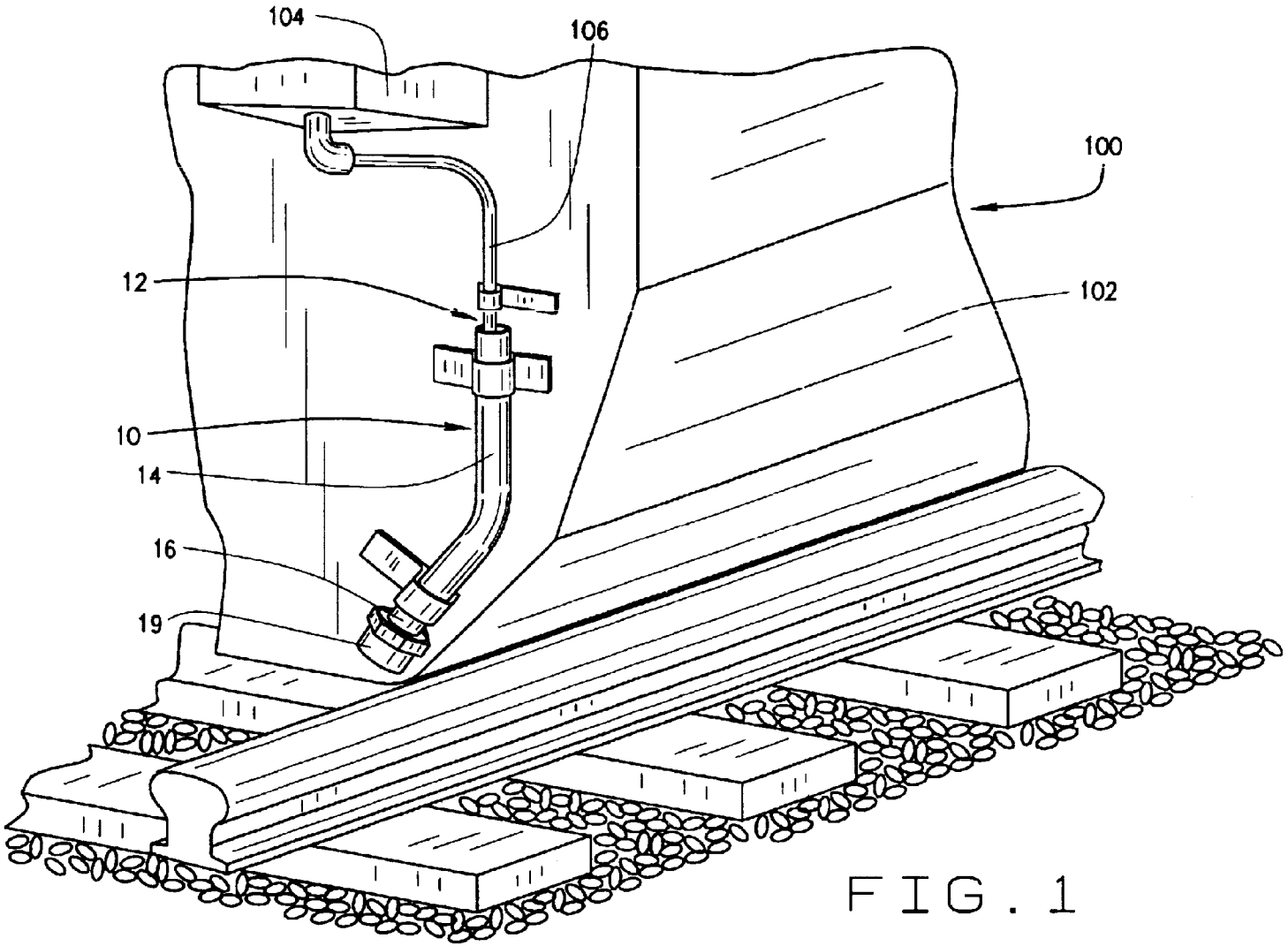
FIG. 1 is a perspective view of the air dryer air discharge pipe of the present invention mounted on a railway locomotive.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Turning to FIGS. 1 and 2, a preferred embodiment of an air dryer air discharge pipe or conduit of the present invention is shown generally at 10. In FIG. 1, the discharge pipe 10 is shown mounted on a railway locomotive, indicated generally at 100, adjacent a fuel tank 102. The discharge pipe 10 has a central axis 11, an inlet end 12, an elongated cylindrical body 14, and a discharge end 16. Alternative configurations may include discharge conduits 10 having non-cylindrical cross sections, such as channels or frames. The inlet end 12 is connection to a air dryer 104 wet-air high pressure outlet 106. Those of ordinary skill in the art will recognize that the general dimensions of the discharge pipe 10, and the type of connection between the discharge pipe 10 and an air dryer wet-air high pressure outlet may be varied depending upon the particular application.

On the side of the elongated body 14 leading away from the inlet end 12, a side air dispersion opening 17 is provided for the discharge pipe 10. In the preferred embodiment, the discharge end 16, opposite of the inlet 12 is preferably completely closed by an end cap 19, such that a discharge of air may only exit the discharge pipe 10 through the side air dispersion opening 17. The side air dispersion opening 17, elongated for maximum area, directs the air towards a fuel tank 102, (or towards another suitable deflector) whereas the stored energy within the air is dissipated. However, those of ordinary skill in the art will recognize that the discharge end 14 may be configured to receive an air diffuser or air deflector element (not shown), or, as is shown, may be closed completely, such as by the end cap 19 or other closure element. Furthermore, the discharge end may be fitted with a diffuser or adapter having an outlet with a cross-sectional area greater than that of the cross-sectional area of the discharge pipe 10 at the discharge end, thereby permitting discharged air to expand in volume and reducing its discharge velocity.

As is seen in FIGS. 2 and 3, the elongated cylindrical body 14 of the discharge pipe 10 preferably includes at least one smooth bend 18 for positioning the discharge end 16 in a desired location upon installation of the discharge pipe 10. In the embodiment shown in FIGS. 2 and 3, the smooth bend 18 is located approximately at the midpoint of the elongated body 14, between the inlet end 12 and the discharge end 16, and is preferably orientated at 45 degrees. Those of ordinary skill in the art will recognize that the dimensions, bends, and configuration of the elongated cylindrical body 14 may be varied from the preferred embodiment as required to position the discharge end 16 in a desired location for varied applications.

As seen in FIG. 1, to facilitate the dispersion of high-pressure wet-air discharged from a locomotive air dyer 104, or other locomotive compressed air system, into the discharge pipe 10, the elongated cylindrical body 14 of the discharge pipe 10 is preferably provided with a first portion A defining a closed cylindrical surface adjacent the inlet end 12, a second portion B defining a closed cylindrical surface adjacent the discharge end 16, and a third portion C defining an open semi-cylindrical surface disposed between portions A and B. The open area of portion C forms at least one side air dispersion opening 17. The air dispersion opening 17 preferably defines a longitudinal slot 22 extending along portion C of the elongated cylindrical body 14. As seen in FIGS. 2 and 3, the side air dispersion opening 17 is preferably positioned such that air dispersed through the side air dispersion opening 17 is radially dispersed from the central axis 11 of the cylindrical body 14.

In this manner, when the discharge pipe 10 is installed on a railway locomotive 100, as shown in FIG. 1, some or all of the wet air discharged through the discharge pipe is laterally directed towards the locomotive fuel tank 102, reducing the velocity of any air discharged through the discharge pipe 10.

Those of ordinary skill in the art will recognize that variations in the placement and dimensions of the air dispersion opening 17 are possible within the scope of the present invention, provided that each embodiment permits the dispersion of sufficient air from the discharge pipe 10 so as to reduce the velocity of air discharged through the side air dispersion opening 17 below a threshold capable of displacing rail line ballast.

In the preferred embodiment shown in FIGS. 3 and 4, the length of portion A of the elongated cylindrical body 14 is approximately three times the length of portion B, while the length of portion C, containing the air dispersion opening 17 is approximately equal to the combined lengths of portions A and B.

For example, in applications wherein the velocity of air discharged from the air dryer 104 into the discharge pipe 10 is relatively low, a small side air dispersion opening 17 may be utilized. Conversely, for applications wherein the velocity of air discharged from the air dryer 104 into the discharge pipe 10 is relatively high, the dimensions of the side air dispersion opening 17 may be increased to provide for additional air pressure reduction within the discharge pipe 10. Alternatively, a plurality of smaller side air dispersion openings (not shown) may be provided over a portion of the discharge pipe 10, replacing a single larger air dispersion opening 17 shown in FIGS. 1 through 4.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. In a railway locomotive having a compressed air system including an air dryer with a high-pressure air discharge outlet, an improved air dyer air discharge pipe having an elongated cylindrical body with first and second ends, an air inlet at a first end adapted to receive air from said high-pressure air discharge outlet, and a second end, the improvement comprising:

said elongated cylindrical body having at least one side air dispersion opening disposed between said first and second ends; and an end cap secured to said second end;

wherein at least a portion of air discharged from said air dryer high-pressure air discharge outlet into said air discharge pipe is dispersed from said air discharge pipe through said at least one side air dispersion opening.

2. The improved air dyer air discharge pipe of claim 1 wherein said elongated cylindrical body includes at least one bend.

3. The improved air dryer air discharge pipe of claim 1 wherein said third portion is configured to disperse a volume of air radially from said elongated cylindrical body.

4. The improved air dryer air discharge pipe of claim 1 further including a discharge outlet in said end cap at said second end.

5. The improved air dryer air discharge pipe of claim 4 wherein said end cap secured to said second end is configured to close at least a portion of said discharge outlet.

6. In a railway locomotive having a compressed air system including an air dryer having a high-pressure air discharge outlet, an improved air dyer air discharge pipe in communication with said air discharge outlet, said discharge pipe having a first end having an air inlet receiving high-pressure air from the air dryer, and a second end located adjacent the underside of the locomotive for discharge of the high-pressure air from the system, the improvement comprising:

a diffuser adjacent said second end of said discharge pipe for directing at least a portion of the high-pressure air to exit the pipe in a generally lateral direction.

7. In a railway locomotive having a compressed air system including an air dryer having a high-pressure air discharge outlet, an improved air dyer air discharge pipe in communication with said air discharge outlet, said discharge pipe having a first end having an air inlet receiving high-pressure air from the air dryer, and a second end located adjacent the underside of the locomotive for discharge of the high-pressure air from the system, the improvement comprising:

a diffuser adjacent said second end of said discharge pipe presenting an exit opening of greater cross-sectional area than cross-section of said discharge pipe at said second end, said diffuser configured to reduce the velocity of said high-pressure air as it exits the pipe.

8. The improved air dyer air discharge pipe of claim 7 wherein said discharge pipe further includes at least one high-pressure air exit disposed between said first and second ends.

9. The improved air dyer air discharge pipe of claim 8 wherein said high-pressure air exit comprises a plurality of openings, at least one of which is disposed on the side of the pipe between said first and second ends.

10. In a railway locomotive having a compressed air system including an air dryer having a high-pressure air discharge outlet, an improved air dyer air discharge pipe in communication with said air discharge outlet, said discharge pipe having an elongated body with a central axis, a first end having an air inlet, and a second end, the improvement comprising:

said elongated body having a first portion adjacent said first end, said first portion defining a closed surface, a second portion adjacent said second end, said second portion defining a second closed surface, and a third portion disposed between said first and second portions, said third portion defining an open surface through which high-pressure air is dispersed.

11. The improved air dryer air discharge pipe of claim 10 wherein said third portion includes at least one bend.

12. The improved air dryer air discharge pipe of claim 10 wherein said third portion defines at least one elongated opening parallel to said central axis.

13. The improved air dryer air discharge pipe of claim 10 wherein said third portion is configured to disperse a volume of air radially from said elongated body.

14. The improved air dryer air discharge pipe of claim 10 further including a discharge outlet at said second end.

15. The improved air dryer air discharge pipe of claim 14 further including a cap secured to said second end, said cap configured to close at least a portion of said discharge outlet.

16. A method for reducing the output velocity of compressed air discharged from an high-pressure air discharge outlet of an air dryer on a railway locomotive compressed air system, comprising:

discharging said air from a high-pressure air discharge outlet of said railway locomotive compressed air system air dryer into a discharge conduit having a first end with an inlet and a second end opposite said first end;

diffusing at least a portion of said air exiting from said discharge conduit; and wherein the output velocity of a portion of said air reaching a railway line on which said railway locomotive is position is reduced below a threshold level sufficient to displace railway ballast from said railway line.

17. The method of claim 16 for reducing the output velocity of compressed air wherein the step of diffusing at least a portion of said air exiting from said discharge conduit includes dispersing at least a portion of said air radially from said discharge conduit between said first and second ends.

18. The method of claim 16 for reducing the output velocity of compressed air wherein the step of diffusing at least a portion of said air from said discharge conduit includes the dispersion of all of said air radially along said portion of said conduit.

19. A method for reducing the output velocity of compressed air discharged from an high-pressure air discharge outlet of an air dryer on a railway locomotive compressed air system, comprising:

discharging said air from a high-pressure air discharge outlet of said railway locomotive compressed air system air dryer into a discharge conduit having a first end with an inlet and a second end opposite said first end;

deflecting at least a portion of said air exiting from said discharge conduit away from a railway line on which said railway locomotive is positioned;

wherein the output velocity of a portion of said air reaching said railway line is reduced below a threshold level sufficient to displace railway ballast from said railway line.

20. The method of claim 19 for reducing the output velocity of compressed air wherein the step of deflection further includes deflecting at least a portion of said air radially from a side of said discharge conduit.

* * * * *